US006409568B1

(12) United States Patent
Søgaard et al.

(10) Patent No.: US 6,409,568 B1
(45) Date of Patent: Jun. 25, 2002

(54) PACKAGED TOY PRODUCT

(75) Inventors: Irene Søgaard, Vejle; Tina Thomsen, Århus C, both of (DK)

(73) Assignee: Interlego AG, Baar (CH)

( * ) Notice: Subject to any disclaimer, the term of this patent is extended or adjusted under 35 U.S.C. 154(b) by 0 days.

(21) Appl. No.: 09/807,671

(22) PCT Filed: Oct. 13, 1999

(86) PCT No.: PCT/DK99/00544

§ 371 (c)(1),
(2), (4) Date: Jun. 25, 2001

(87) PCT Pub. No.: WO00/21845

PCT Pub. Date: Apr. 20, 2000

(30) Foreign Application Priority Data

Oct. 14, 1998 (DK) ..... 1998 01312

(51) Int. Cl.[7] ..... A63H 3/50
(52) U.S. Cl. ..... 446/73; 446/76; 206/459.1
(58) Field of Search ..... 446/71, 72, 73, 446/75, 76, 423; 206/459.1, 776

(56) References Cited

U.S. PATENT DOCUMENTS 4,585,123 A * 4/1986 Penry ..... 206/387
4,809,847 A * 3/1989 Schneider ..... 206/45.31
5,411,138 A 5/1995 Klawiter
5,636,741 A 6/1997 O'Keefe
5,775,494 A * 7/1998 Taplin ..... 206/308.2
6,098,794 A * 8/2000 Lin ..... 206/217

FOREIGN PATENT DOCUMENTS

GB 2 147 566 5/1985
WO WO 99/07609 2/1999

* cited by examiner

*Primary Examiner*—Kien T. Nguyen
(74) *Attorney, Agent, or Firm*—Pitney, Hardin, Kipp & Szuch LLP

(57) ABSTRACT

A packaged toy product in which a number of toy elements are packaged. The packaging comprises a box wherein the top face of the box is provided with a transparent opening. The packaging is also configured with at least one compartment under the transparent opening in which one or more elements of the product are arranged. The compartment is configured as an elongated path with the path corresponding to at least the largest dimension of the elements such that the elements shift a distance along the path under the transparent opening.

11 Claims, 3 Drawing Sheets

PACKAGED TOY PRODUCT

The present invention relates to a packaged toy product, which product comprises a number of toy elements, and wherein the associated packaging comprises a box with a bottom face and a top face and a number of lateral faces that extend between the bottom face and the top face; and wherein the top face is provided with at least one transparent opening that allows a viewer to see at least a part of the matter contained in the packaging through the transparent opening in the top face; and wherein said packaging is configured with at least one compartment in which one or more of the toy elements that are constituents of the toy product are arranged, said compartment being located underneath the transparent opening in the top face of the box, whereby the matter contained in the compartment can be seen through said transparent opening.

Several embodiments of such packaged toy products are known wherein the compartment is configured in such a manner that the product contained in the compartment is secured in such a way that the viewer can readily see the toy product contained in the box in its entirety or at least partially.

In connection with certain types of toys, such as toy building sets, it is desired in particular that only a part of the matter contained therein is visible to the viewer of the packaged product, many constituent components of such toy building set being arranged more or less disorganised in compartments, boxes or bags intended therefor in the packaging.

Therefore packaged toy building products are also known in which only a few parts of the product contained in the packaging can be seen through the transparent opening in the lid; and wherein the remaining parts of the toy product stay hidden to the viewer underneath the lid.

In the light of this it is the object of the present invention to provide a packaged product of the kind described above, whereby—in addition to easy display of single constituents of the toy product contained in the packaging—it is also possible to a certain degree to manipulate this product in such a manner that it is possible to play with the product contained in the packaging without opening said packaging.

In accordance with the present invention this is obtained in that the compartment is configured as an elongated path, and wherein the elongated path contains at least one toy element, said toy element having such height and width that allow the toy building element to be shifted a distance along the path by movement of the packaging, said path corresponding at least to the largest dimension of the toy element.

According to a preferred embodiment, the transparent opening in the top face has a width in the top face plane that corresponds to the width of the path. This is useful in particular when the top face next to the path is to be provided with pictures or prints depicting other constituents of the product contained in the packaging in organised or assembled state.

It is furthermore preferred that the transparent opening in the top face follows the path in the entire longitudinal direction of the path.

In a further preferred embodiment the transparent opening is closed in the plane of the top face by means of a transparent plastics film which eliminates the need for separate packaging elements for final closing of the packaging.

In a particularly preferred embodiment, the bottom face 5 is provided with a removable insert, which insert consists of a unit having a top face which has essentially the same shape as the internal dimensions of the bottom face, and wherein the path is configured as an indentation in the top face of the insert, and said top face being provided with a support that lifts the top face on the insert up below the top face of the packaging thereby enabling the top face of the packaging to simultaneously serve as lid for the path.

In this context the insert can advantageously consist of a plastics sheet shaped in a vacuum-shaping process which means that this part of the packaging can be manufactured in a simple and inexpensive manner.

In a further preferred embodiment the insert is, the path apart, configured such that it has one or more further compartments arranged in the top face of the insert, said further compartments serving to contain other toy elements in the packaging.

If, in this context, the top face has at least one further transparent opening that allows a viewer to see at least a part of the contents of the further compartments through the transparent opening in the top face of the packaging, it is accomplished that some of the remaining constituents of the toy product can be rendered visible to the viewer.

Particularly advantageously, the path forms a road that comprises at least one turn since it is hereby accomplished that paths are formed that have different shapes which encourages testing of the product contained in the packaging and whereby different effects can be accomplished by movement of the packaging.

Besides, the packaged toy product can advantageously contain two or more paths, and provided each path contains one or more displaceably arranged toy element(s) it is possible to accomplish further effects by movement of the packaging.

According to a particularly preferred embodiment the packaged toy product arranged on a path is a model vehicle or a model vessel.

In a further preferred embodiment of the invention the toy product can conveniently comprise a further element, and wherein the indentation in the top face of the insert is configured such that the further element can be positioned in the indentation, and such that the indentation and the further element jointly form the above-mentioned path. Thus, it is hereby is possible—provided the toy element arranged in the path is a vehicle, a vessel or the like wherein the packaged toy product also comprises rails, roads or the like—to display the functioning and interaction of such with the vehicle or the vessel in combination therewith by the vehicle or the vessel in the packaging moving along the rail or the road.

The invention will now be described in further detail with reference to the drawings, wherein.

Figure 1:
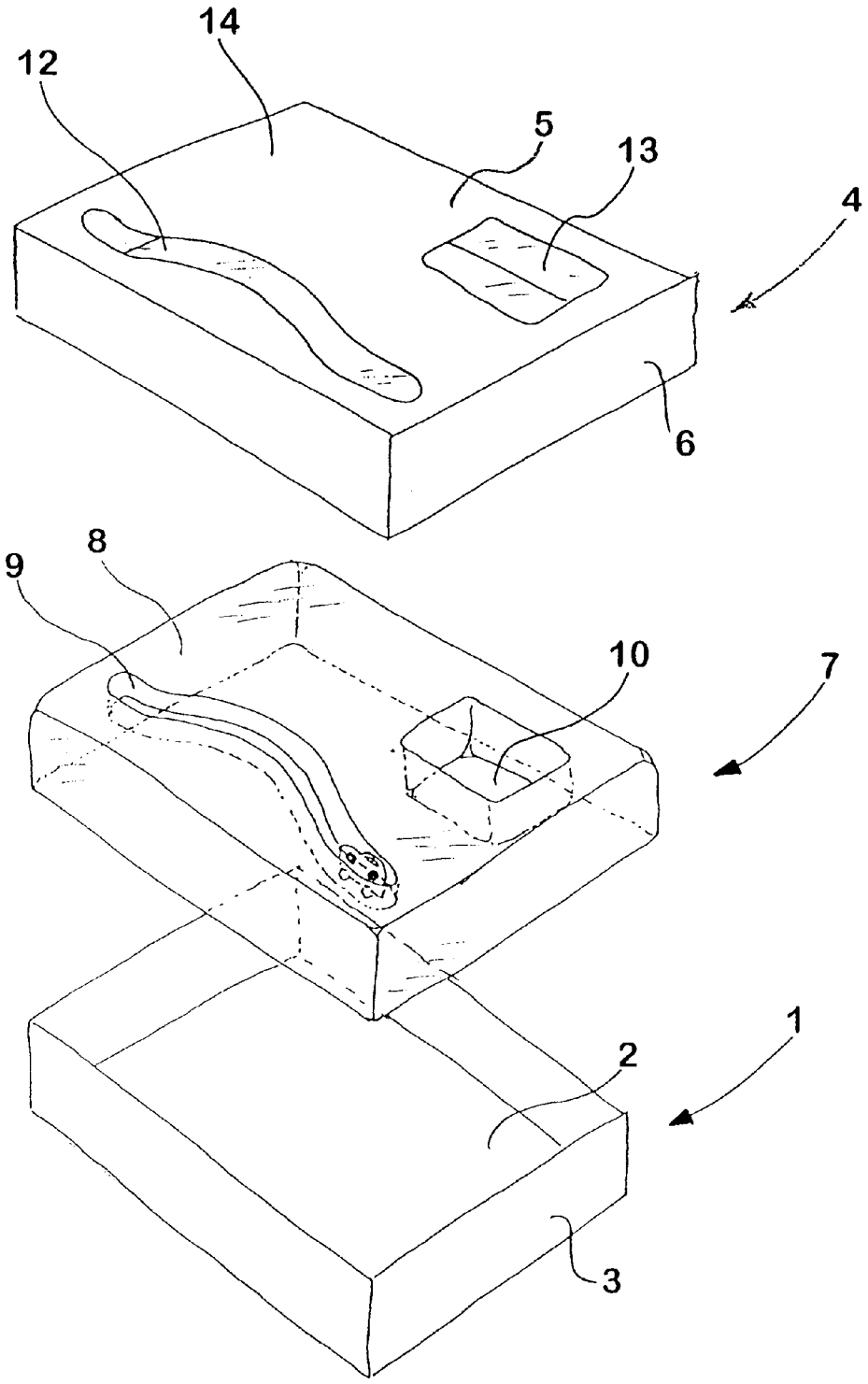
FIG. 1 is a perspective view showing a packaged toy product according to the invention in its partially disassembled state.
Figure 2:
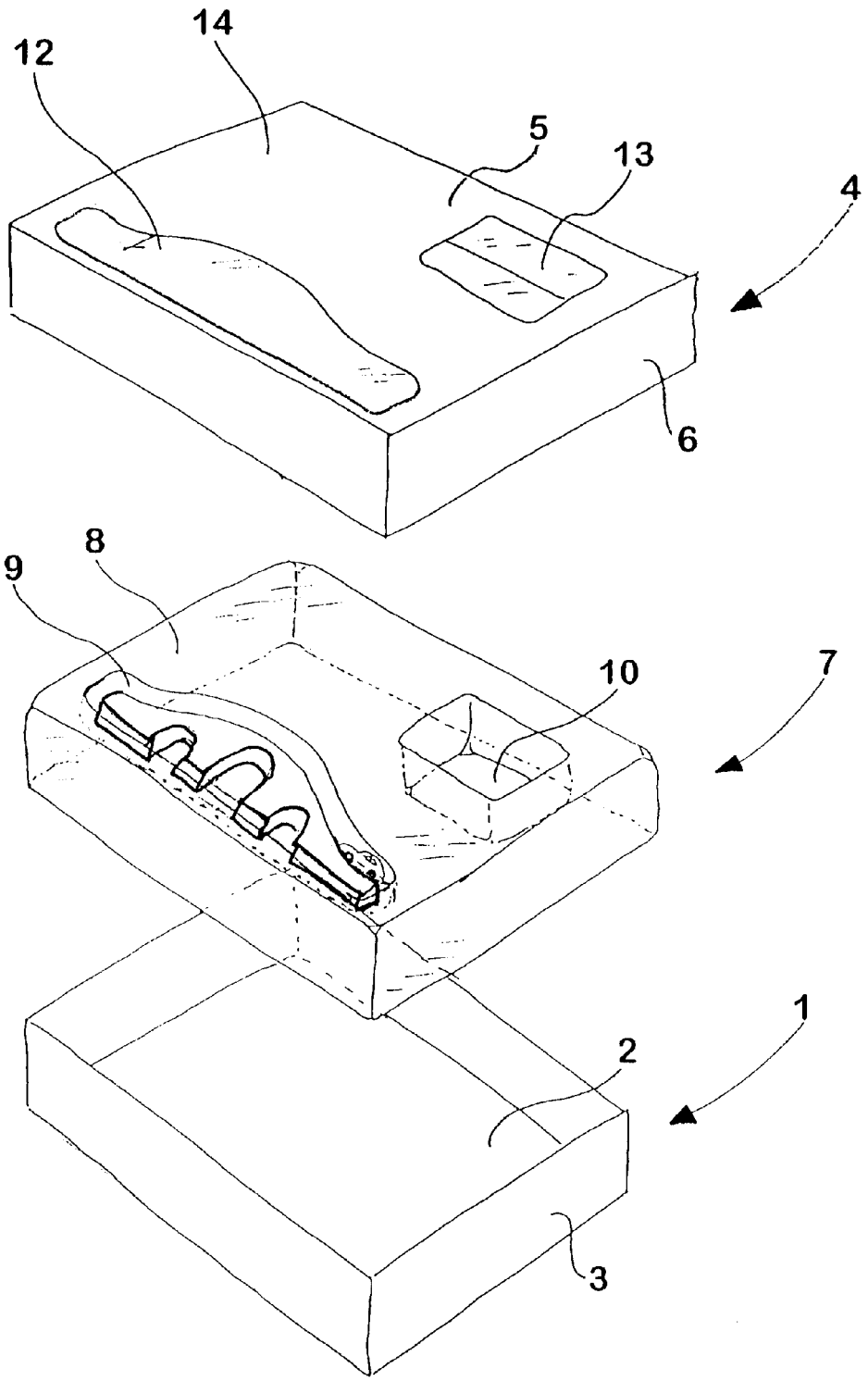
FIG. 2 is a perspective view of an alternative embodiment of a packaged toy product according to the invention in a partially disassembled view.

Thus, FIGS. 1 and 2 illustrate a packaging according to the present invention featuring a toy product.

The packaging comprises a bottom portion 1 having a rectangular bottom face 2 which is delimited by lateral faces 3.

Moreover, the packaging comprises a lid 4 having a top face 5 with a rectangular shape that corresponds to the bottom face 2, and wherein the top face 5 on the lid 4 is delimited by lateral faces 6 whereby the lid 4 can be pressed down over the bottom part 1 and thus form a closed box-shaped packaging. As shown the lid 4 has a first transparent opening 12 provided with a transparent film. This first transparent opening has, as will appear, the same shape as the path described below in the insert 7. Moreover the top face has a second transparent opening 13 which is also covered by a transparent film and has a shape that matches the further compartment in the insert as will be described below.

Between the lid 4 and the bottom portion 1, an insert 7 is provided which is preferably made of a plastics material in a vacuum-shaping process, and as will appear from the figure, it can be made of a transparent material. The insert 7 has a top face 8 in which a path 9 in the form of an elongate indentation is configured, in which there is, in accordance with the invention, arranged an element from the product contained in the packaging, in this case in the form of a vehicle 11, even though, in principle, it could be any other element, such as a ball, a sledge, a vessel, a train, etc.

As will appear, the vehicle 11 according to the invention can be displaced in the track in a simple manner by tilting of the packaging or the insert 7.

Preferably the lid is made of a non-transparent material, such as carton or cardboard, wherein said openings have been punched. This means that the top face features non-transparent surfaces 14 for mounting or printing so as to surround the transparent openings by depictions showing other elements of the material contained in the packaging and thus in a simple manner to display the visible products in a context.

Besides, the insert 7 further features an additional indentation that forms a further compartment 10 which may contain other, not shown elements of the product contained in the packaging.

In a corresponding manner, FIG. 2 shows an alternative embodiment of the present invention from which it will appear that the path 9 is formed by a bridge-like element being arranged in the insert 7.

Thus the viewer is able to see the vehicle 11 arranged in the path drive along the bridge-like element.

Thus the indentation may contain a number of additional elements that are constituents of the packaged toy product whereby various functions can be demonstrated which can be accomplished by use of the toy product.

Figure 3:
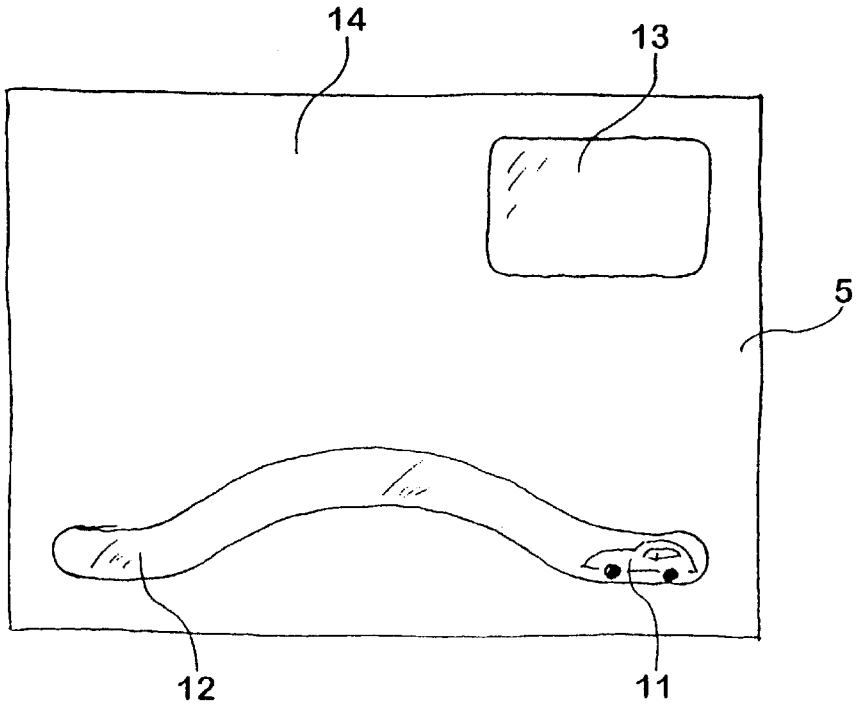
FIG. 3 is a top view of the packaged toy building product shown in FIG. 1 in its assembled state.
Figure 4:
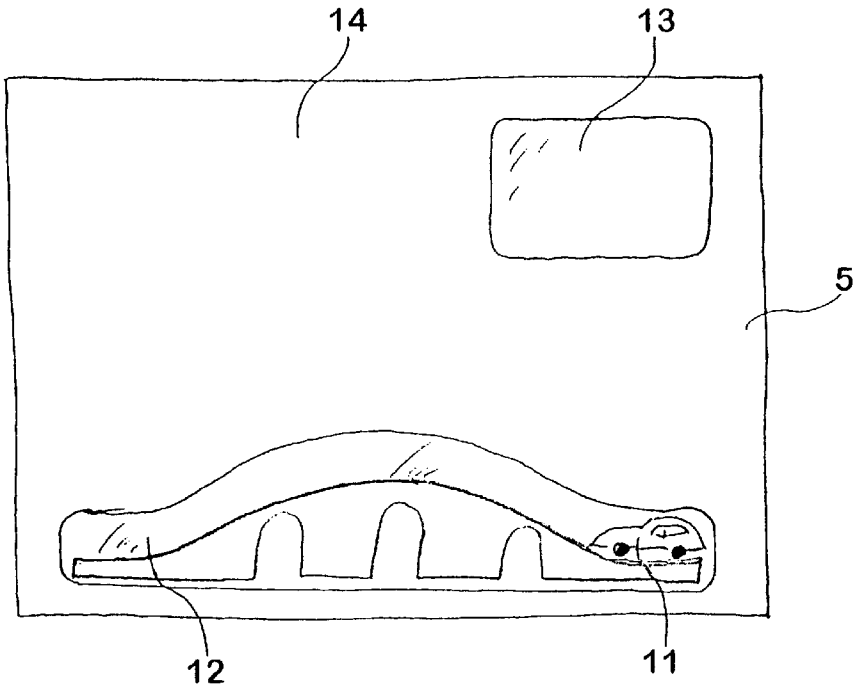
FIG. 4 is a top view of the packaged toy product shown in FIG. 3 in its assembled state.

Following assembly of the packagings shown in FIG. 1 and, it will thus be possible to accomplish a closed packaging as shown in FIGS. 3 and 4 wherein the top face of the lid is seen from above. As will appear, it is thus possible to see through the transparent openings 12,13 down into the path 9 and the compartment 10 in the insert 7, whereby it is possible, as regards the path 9, to tilt the closed packaging in such a manner that the vehicle 11 in the path 9 is shifted thereby.

Thus, it is possible with the present invention to provide a package toy product that makes it possible to play with the toy contained therein already prior to unpacking of the product, and—as should be noted—without touching the packaged product. This is shown in the Figure in one embodiment, but obviously variations can be carried out in the fundamental construction of the packaging and the configuration of the path 9 without departing from the fundamental principle of the invention, and hence the packaging shown and the embodiment shown are to be construed merely as exemplary configurations.

What is claimed is:

1. A packaged toy product, said product comprising a number of toy elements with associated packaging, and wherein the associated packaging comprises a box with a bottom face and a top face and a number of lateral faces that extend between the bottom face and the top face, and wherein the top face is configured with at least one transparent opening that allows a viewer to see at least a part of the matter contained in the associated packaging through the transparent opening in the top face, and wherein the associated packaging features at least one compartment in which one or more of the toy elements of the toy product is/are arranged, said compartment being located underneath the transparent opening, whereby the contents of the compartment can be viewed through the transparent opening, characterized in that the compartment is configured as an elongate path, and wherein the path is arranged for at least one toy element, in which the at least one toy element has a height and a width, such that the at least one toy element may be shifted a distance along the path by movement of the packaging, said distance corresponding at least to the largest dimension of the at least one toy element.

2. A packaged toy product according to claim 1, characterized in that the path has a substantially uniform width in the entire longitudinal direction thereof, and that the transparent opening in the top face has a width in the plane of the top face that corresponds to the width of the path.

3. A packaged toy product according to claim 1, characterized in that the transparent opening in the top face follows the path in the entire longitudinal direction of the path.

4. A packaged toy product according to claim 1, characterized in that the transparent opening is enclosed in the plane of the top face by means of a transparent plastic film.

5. A packaged toy product according to claim 1, characterized in that the associated packaging features a removable insert, said insert being constituted by a unit that has a top face which has substantially the same shape as the interior dimensions of the bottom part, and wherein the path is shaped as an indentation in the top face of the insert, and wherein the top face is provided with a support that lifts the top face of the insert upwards underneath the top face of the packaging whereby the top face also serves as a lid for the path.

6. A packaged toy product according to claim 5, characterized in that the insert is constituted of a plastics sheet shaped in a vacuum-shaping process.

7. A packaged toy product according to claim 5, characterized in that the insert comprises, the path apart, one or more further indentations configured in the top face of the insert, said indentations serving as compartments for containing other toy elements of the toy product.

8. A packaged toy product according to claim 7, characterized in that the top face has at least one further transparent opening that allows a viewer to see at least part of the contents of the compartments for containing other toy elements through the further transparent opening in the top face.

9. A packaged toy product according to claim 5, characterized in that the toy product comprises a further element, and in that the indentation in the top face of the insert is configured such that the further element can be located in the indentation, and such that the indentation and the further element combine to form said path.

10. A packaged toy product according to claim 1, characterized in that the path follows a road that has at least one turn.

11. A packaged toy product according to claim 1, characterized in that the associated packaging comprises two or more paths, and that, in each path one or more toy elements are arranged that can be displaced in said paths.

* * * * *